US008147224B2

(12) United States Patent
Tsai

(10) Patent No.: US 8,147,224 B2
(45) Date of Patent: Apr. 3, 2012

(54) AIR PUMP WITH A ONE-PIECE CYLINDER

(75) Inventor: Chun-Chung Tsai, Dongguan (CN)

(73) Assignee: Dongguan Tiger Point, Metal & Plastic Products Co., Ltd., Dongguan (CN)

( * ) Notice: Subject to any disclaimer, the term of this patent is extended or adjusted under 35 U.S.C. 154(b) by 462 days.

(21) Appl. No.: 12/431,939

(22) Filed: Apr. 29, 2009

(65) Prior Publication Data

US 2010/0278670 A1 Nov. 4, 2010

(51) Int. Cl.
*F04B 23/04* (2006.01)

(52) U.S. Cl. ..... 417/521; 417/455; 417/545

(58) Field of Classification Search ..... 417/446, 417/455, 460, 467–469, 481, 521, 545, 546
See application file for complete search history.

(56) References Cited

U.S. PATENT DOCUMENTS

| | | | | |
|---|---|---|---|---|
| 6,325,601 | B2 * | 12/2001 | Wu | 417/469 |
| 6,371,741 | B1 * | 4/2002 | Wu | 417/446 |
| 6,428,290 | B1 * | 8/2002 | Wang | 417/468 |
| 6,652,242 | B2 * | 11/2003 | Wu | 417/63 |
| 6,676,390 | B2 * | 1/2004 | Wang | 417/528 |
| 7,331,768 | B2 * | 2/2008 | Wu | 417/63 |
| 2002/0106293 | A1 * | 8/2002 | Carlson | 417/553 |
| 2003/0156960 | A1 * | 8/2003 | Wang | 417/528 |
| 2004/0156726 | A1 * | 8/2004 | Wu | 417/63 |
| 2007/0221056 | A1 * | 9/2007 | Kutella | 92/61 |

* cited by examiner

*Primary Examiner* — Bumsuk Won
(74) *Attorney, Agent, or Firm* — Rabin & Berdo, P.C.

(57) ABSTRACT

An air pump has a one-piece cylinder and a piston assembly. The one-piece cylinder has a body, a cap, a pedal and a base formed together by injection molding and welding process. The piston assembly is mounted in the one-piece cylinder and has a rod, a handle and a piston. The one-piece cylinder is structurally firm and provides excellent hermetic characteristics.

3 Claims, 8 Drawing Sheets

AIR PUMP WITH A ONE-PIECE CYLINDER

BACKGROUND OF THE INVENTION

1. Field of the Invention

The present invention relates to a pump, and more particularly to an air pump that has a one-piece cylinder being structurally firm and providing excellent hermetic characteristics to prevent leakage and disassembly under high pressure.

2. Description of Related Art

Air pumps are popularly used in daily life to pump air into inflatable products such as basketballs and tyres.

With reference to FIG. 1, a conventional air pump has a cylinder and a piston assembly.

The cylinder has an air inlet, an air outlet, a body (120*a*) and a cap (110*a*) and a pedal base (130*a*).

The air inlet and outlet are defined in the cylinder.

The body (120*a*) has a chamber, an open top and an open bottom. The chamber has an inner sidewall.

The cap (110*a*) is mounted securely on the open top and has a through hole (111*a*) and an O-ring (141*a*). The through hole (111*a*) is defined through the cap (110*a*). The O-ring (141*a*) is mounted hermetically between the cap (110*a*) and the open top.

The pedal base (130*a*) is mounted securely on the open bottom and has an O-ring (142*a*) hermetically mounted between the pedal base (130*a*) and the open bottom.

The piston assembly has a shaft (210*a*), a handle (200*a*) and a piston (230*a*).

The shaft (210*a*) is mounted through the through hole (111*a*) of the cap (110*a*) in the chamber of the body (120*a*) and has a top end and a bottom end.

The handle (200*a*) is mounted on the top end of the shaft (210*a*). Reciprocally moving the handle (200*a*) drives the shaft (210*a*) to move up and down in the chamber.

The piston (230*a*) is mounted on the bottom end of the shaft (210*a*) and hermetically contacts the inner sidewall of the chamber of the body (120*a*). The piston (230*a*) is reciprocally driven to supply air into the chamber through the air inlet and pump air into an inflatable product through the air outlet.

However, the cylinder assembled by the separate components of the body (120*a*), cap (110*a*) and pedal base (130*a*) has following disadvantages.

1. When stored, separate components of the cylinder require management such as classification and indexing so increases storage costs.

2. Tolerances of the separate components are different so that precisely assembling the components into a cylinder is difficult and thus lowers quality and production rate of the air pump.

To overcome the shortcomings, the present invention provides an air pump with a one-piece cylinder to mitigate or obviate the aforementioned problems.

SUMMARY OF THE INVENTION

The main objective of the invention is to provide an air pump that has a one-piece cylinder being structurally firm and providing excellent hermetic characteristics to prevent leakage and disassembly under high pressure.

An air pump in accordance with the present invention has a one-piece cylinder and a piston assembly. The one-piece cylinder has a body, a cap, a pedal and a base formed together by injection molding and welding process. The piston assembly is mounted in the one-piece cylinder and has a rod, a handle and a piston. The one-piece cylinder is structurally firm and provides excellent hermetic characteristics.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1 to 4, an air pump in accordance with the present invention comprises a one-piece cylinder (100) and a piston assembly (200).

Figure 8:
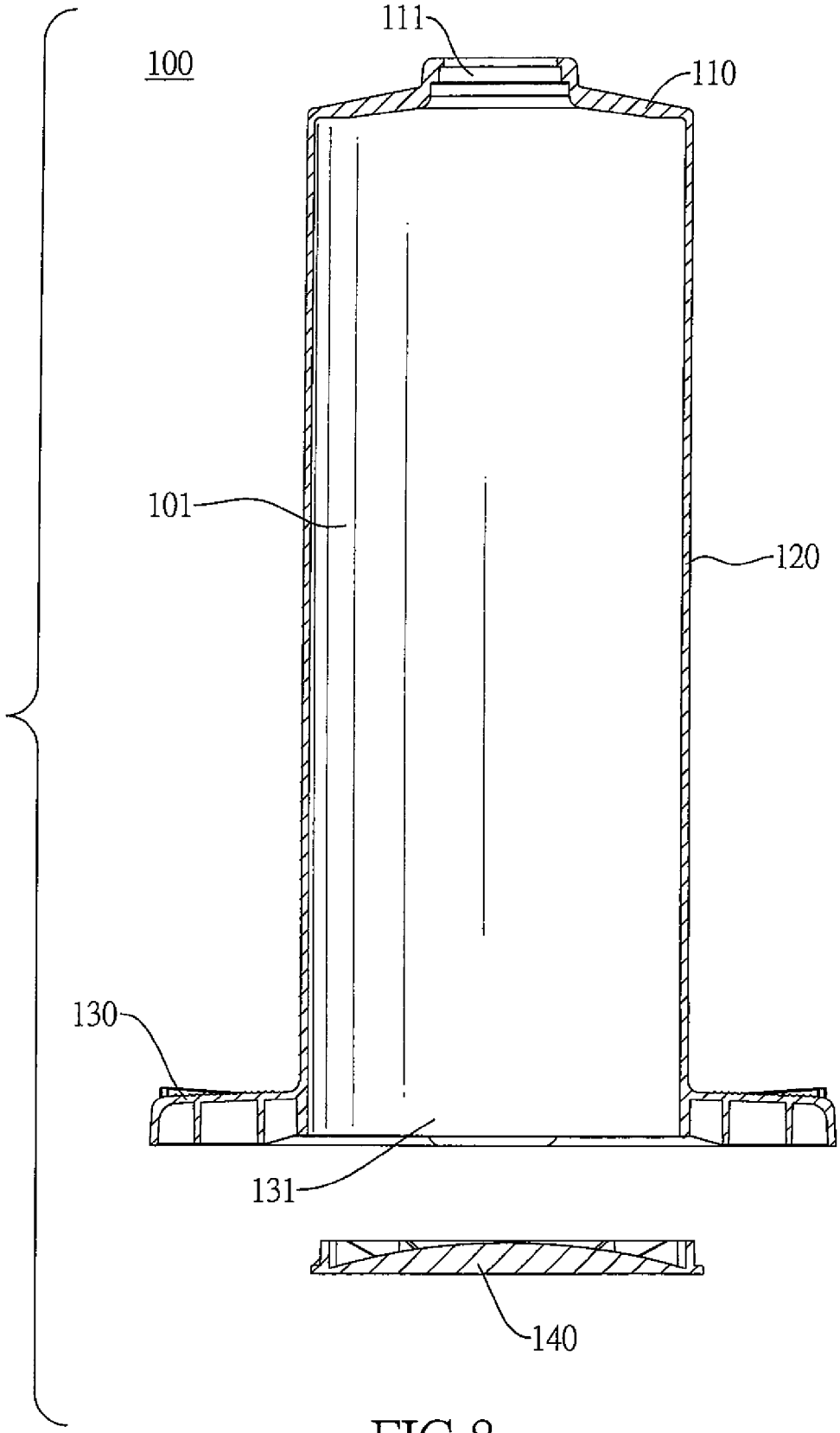
FIG. 8 is an exploded sectional side view of a body and a base of the cylinder of the air pump in FIG. 4.

With further reference to FIG. 8, the one-piece cylinder (100) has a body (120), a cap (110), a pedal (130) and a base (140).

The body (120) may be plastic and has a top end, an open bottom end (131) and a chamber (101) defined in the body (120) and the chamber (101) having an inner sidewall.

The cap (110) may be plastic, is formed on the top end of the body (120) by an injection molding process and has a through hole (111) defined through the cap (110).

The pedal (130) may be plastic, is formed radially on the bottom end of the body (120) by the injection molding process and may have two opposite pedal members so that a user's feet may respectively step on the pedal members.

The base (140) may be plastic and is formed on and closes the open bottom end (131) of the body (120) by an ultrasonic welding, spin welding or high-frequency welding process.

The piston assembly (200) is mounted slidably in the chamber (101) of the cylinder (100) before the base (140) is welded to the body (120) of the cylinder (100) and has a rod, a handle (230) and a piston (240).

The rod extends through the through hole (111) in the chamber (101) and has an outer tube (220) and an inner tube (210).

The outer tube (220) is mounted through the through hole (111) of the cap (110), extends slidably in the chamber (101) of the cylinder (100) and has a top end, a bottom end and a central hole (203). The central hole (203) is defined through the outer tube (220) and has a diameter.

The inner tube (210) is mounted in the central hole (203) of the outer tube (220) and has a top end, a bottom end, an outer diameter and an outlet channel (211). The outer diameter of the inner tube (210) is smaller than the diameter of the central hole (203) so that the central hole (203) serves as an air passageway. The outlet channel (211) is defined through the inner tube (210).

The handle (230) is mounted securely on the top ends of the outer tube (220) and the inner tube (210) out of the cylinder (100) and has an inlet hose (231) and an outlet hose (232). The inlet hose (231) is defined on the handle (230) and communicates with the central hole (203) of the outer tube (220). The outlet hose (232) is defined on the handle (230) and communicates with the outlet channel (211) of the inner tube (210). When the air pump is operated, ambient air flows into the chamber (101) through the inlet hose (231) and is pumped into an inflatable product through the outlet hose (232).

The piston (240) is mounted securely on the bottom ends of the outer tube (220) and the inner tube (210), hermetically contacts the inner sidewall of the chamber (101) of the cylinder (100) to divide the chamber (101) into an upper sub chamber and a lower sub chamber. The piston (240) has a top, a bottom, an outer edge, an annular groove (242), a radial passage (241), an outlet cavity (201), an inlet cavity (202), multiple downstroke holes (245), multiple upstroke holes (246), an O-ring (260), a downstroke valve (251) and an upstroke valve (252).

The annular groove (242) is defined in the outer edge.

The radial passage (241) is defined radially in the outer edge and selectively communicates with the upper or lower sub chamber.

The outlet cavity (201) is defined in the piston (240) and communicates with the radial passage (241) and the outlet channel (211) of the inner tube (210).

The inlet cavity (202) is defined in the piston (240) and communicates with the central hole (203) of the outer tube (220).

The downstroke holes (245) are defined through the top of the piston (240) and communicate with the inlet cavity (202) and the upper sub chamber.

The upstroke holes (246) are defined through the bottom of the piston (240) and communicate with the inlet cavity (202) and the lower sub chamber.

The O-ring (260) is mounted in the annular groove (242), hermetically contacts the inner sidewall of the chamber (101) and is moveable to selectively abut the top or bottom of the piston (240). The O-ring (260) abutting the top of the piston (240) sets the radial passage (201) to communicate with the lower sub chamber. Alternatively, the O-ring (260) abutting the bottom of the piston (240) sets the radial passage (241) to communicate with the upper sub chamber.

The downstroke valve (251) may be rubber, is resiliently mounted on the top of the piston (240) and selectively opens the downstroke holes (245).

The upstroke valve (252) may be rubber, is resiliently mounted on the bottom of the piston (240) and selectively opens the upstroke holes (246).

Figure 1:
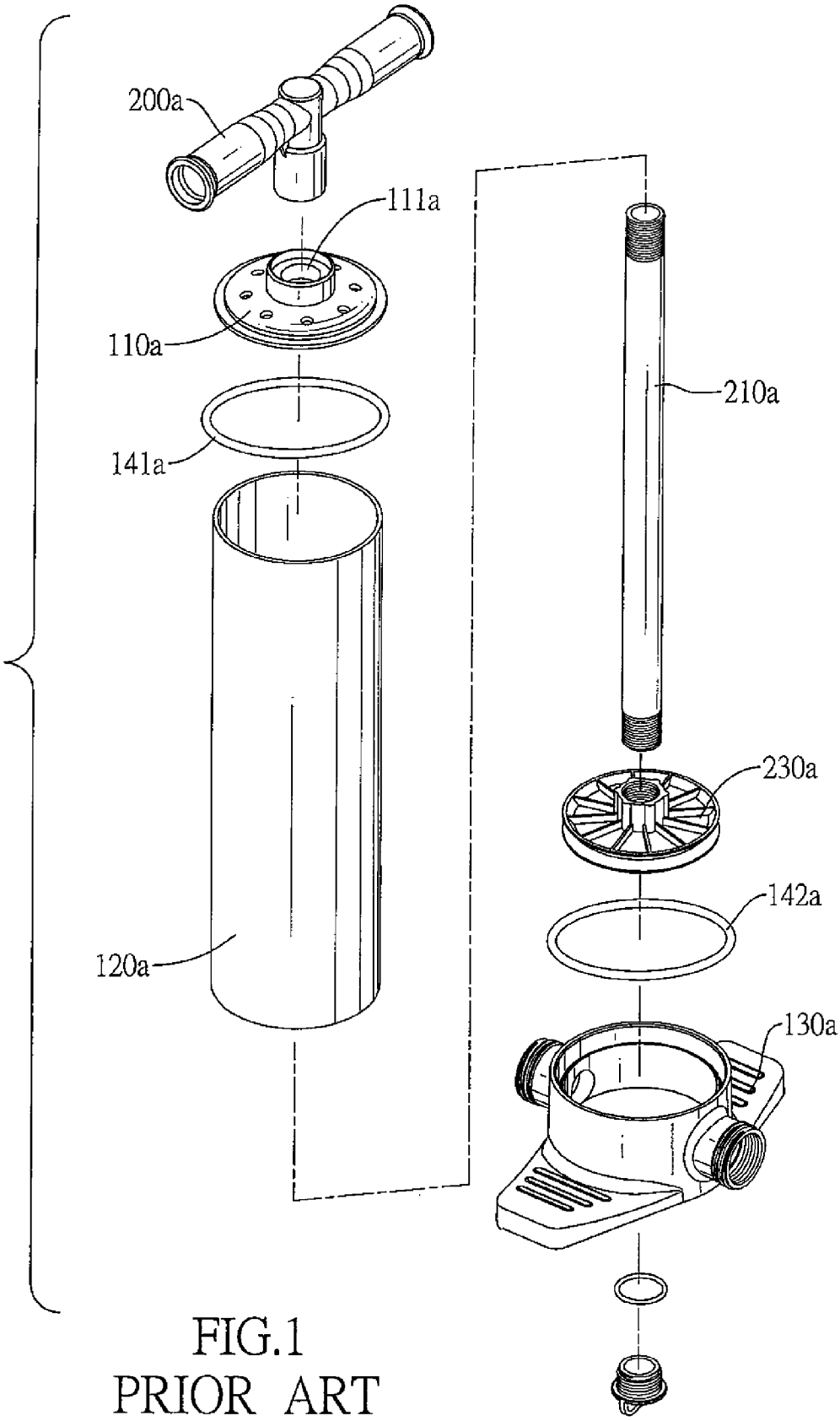
FIG.1 PRIOR ART
FIG. 1 is an exploded perspective view of a conventional air pump in accordance with the prior art.
Figure 2:
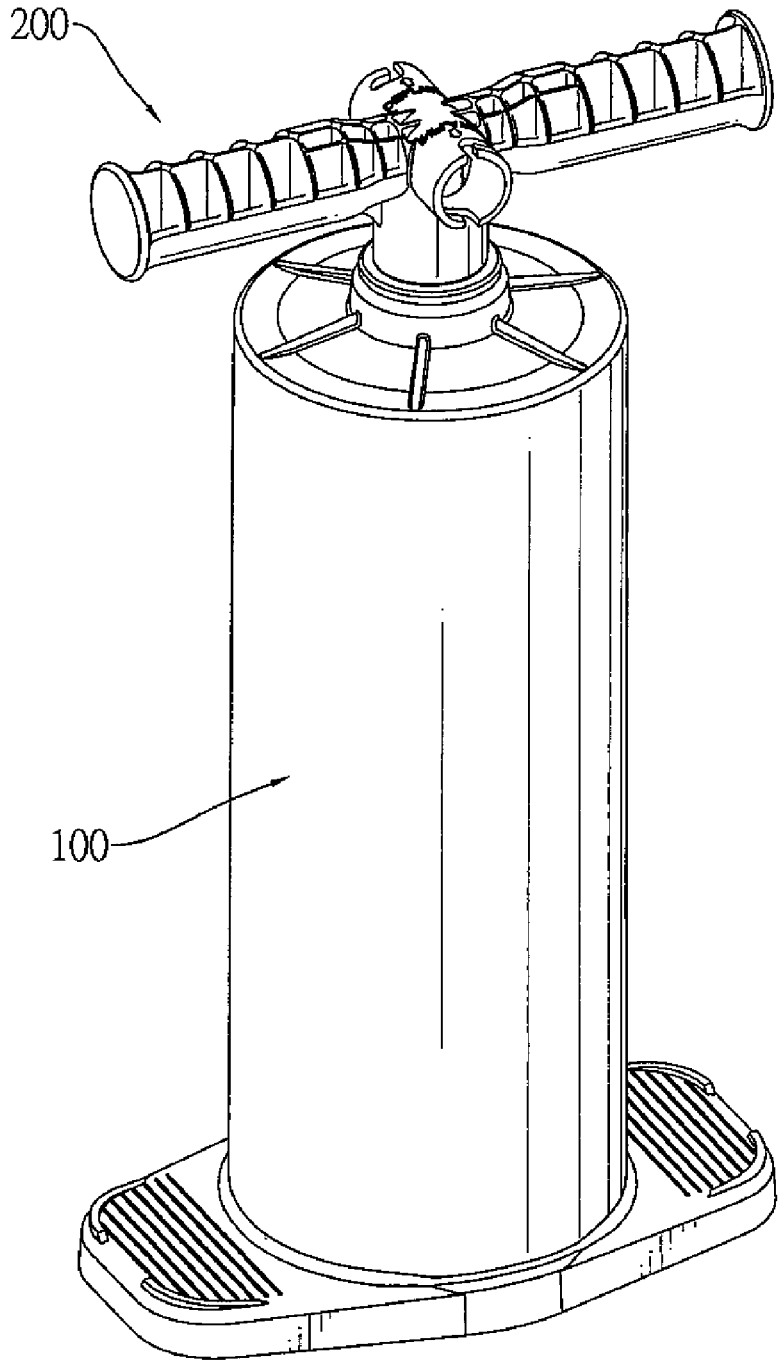
FIG. 2 is a perspective view of an air pump with a one-piece cylinder in accordance with the present invention.
Figure 3:
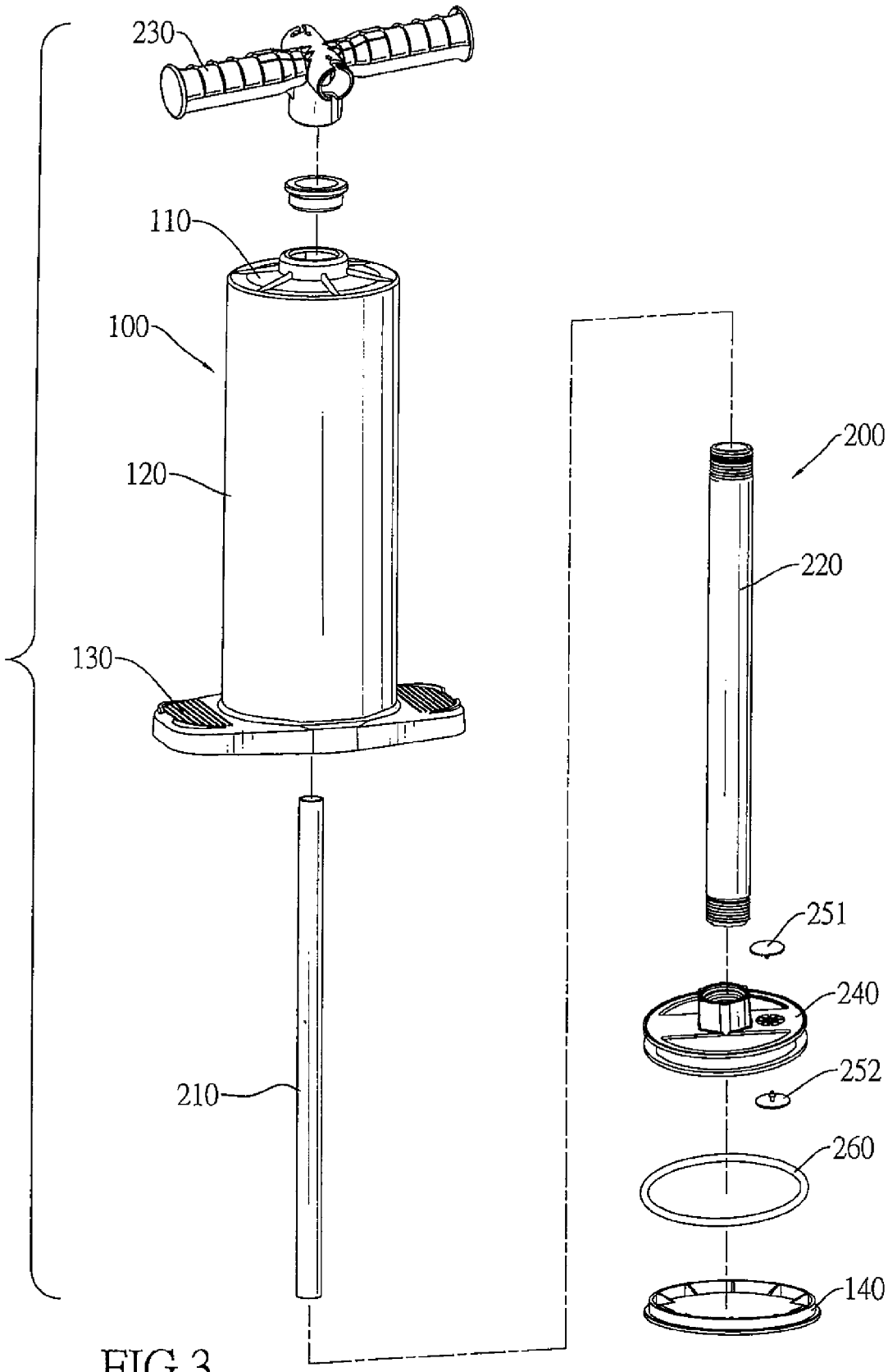
FIG. 3 is an exploded perspective view of the air pump in FIG. 2.
Figure 4:
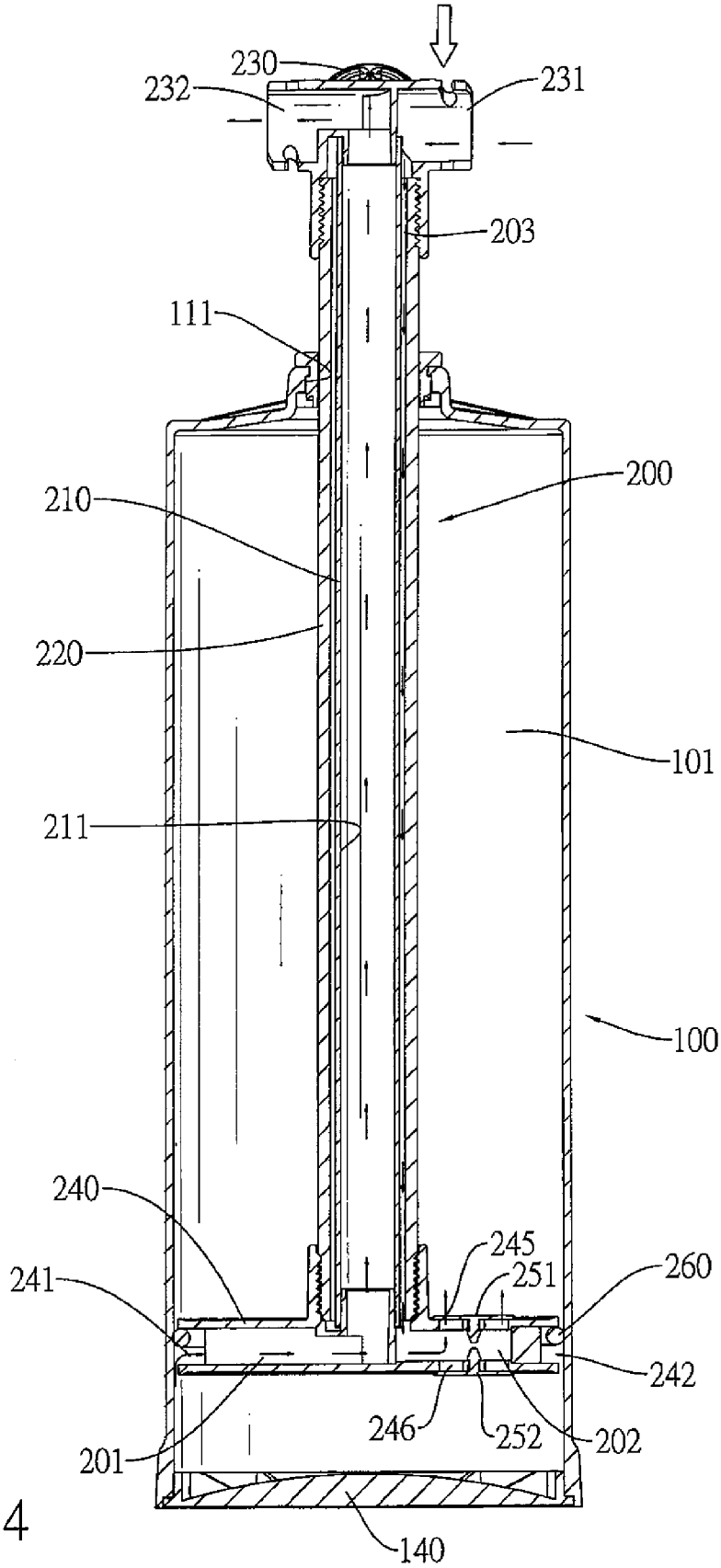
FIG. 4 is an operational cross sectional side view of the air pump in FIG. 2 with a piston assembly in a downstroke.
Figure 5:
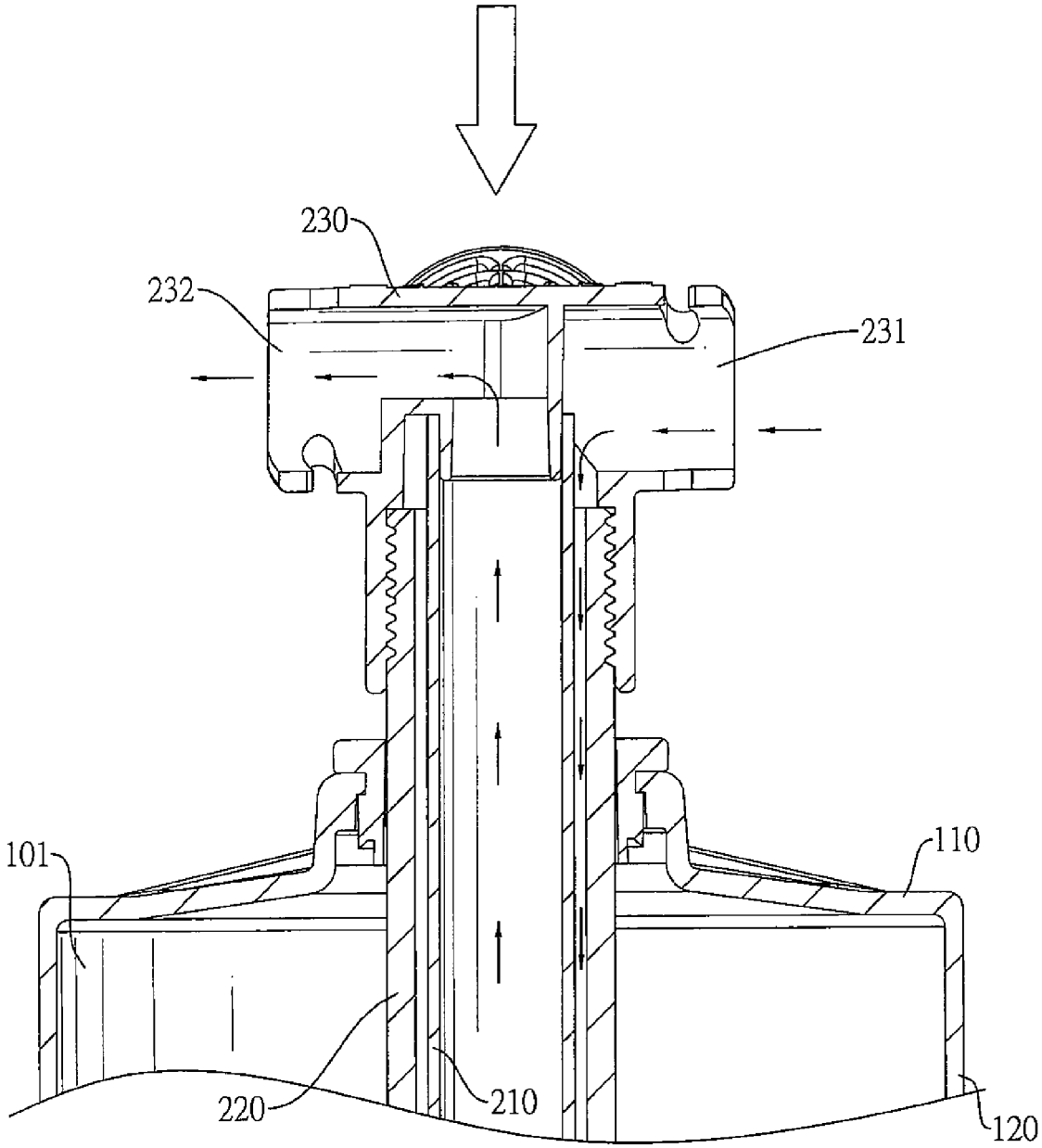
FIG. 5 is an enlarged cross sectional side view of the air pump in FIG. 4.
Figure 6:
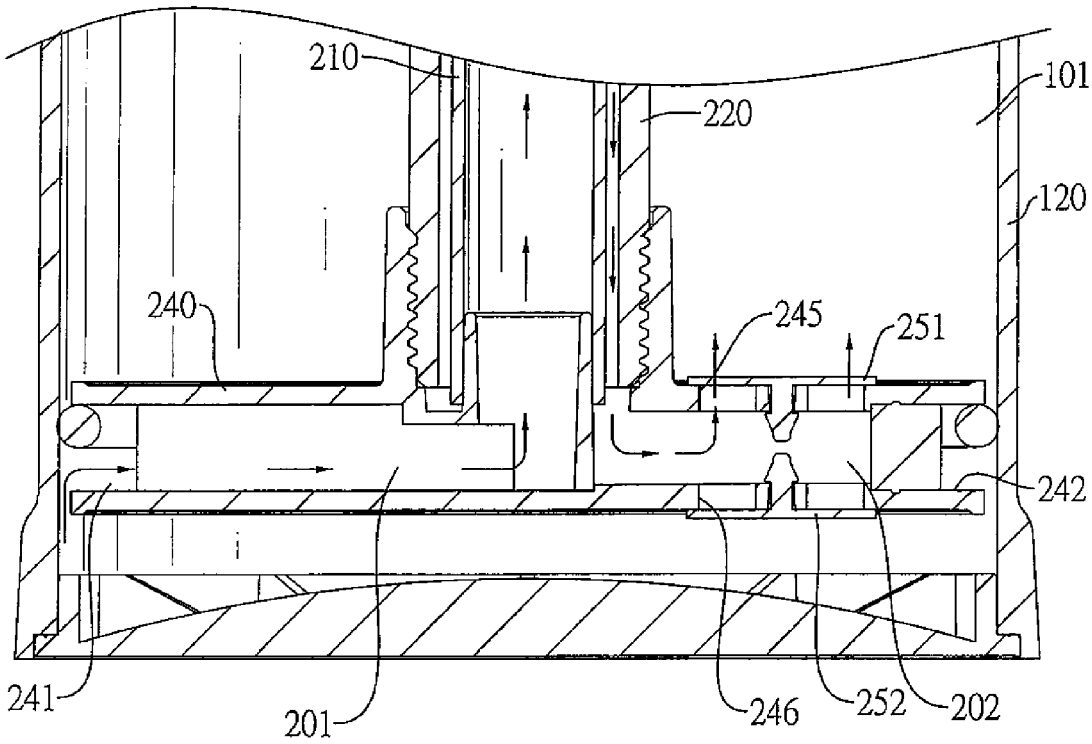
FIG. 6 is another enlarged cross sectional side view of the air pump in FIG. 4.

With further reference FIGS. 4 to 6, in the downstroke, moving the piston assembly (200) downwards forces ambient air to flow into the inlet hose (231) of the handle (230), pass through the central hole (203), the inlet cavity (202), the downstroke holes (245), and then open the downstroke valve (251) to enter the upper sub chamber. The O-ring (260) abuts the top of the piston (240) and the air in the lower sub chamber flows through the radial passage (241), the outlet cavity (201), the outlet channel (211) and the outlet hose (232) and than enters the inflatable product.

Figure 7:
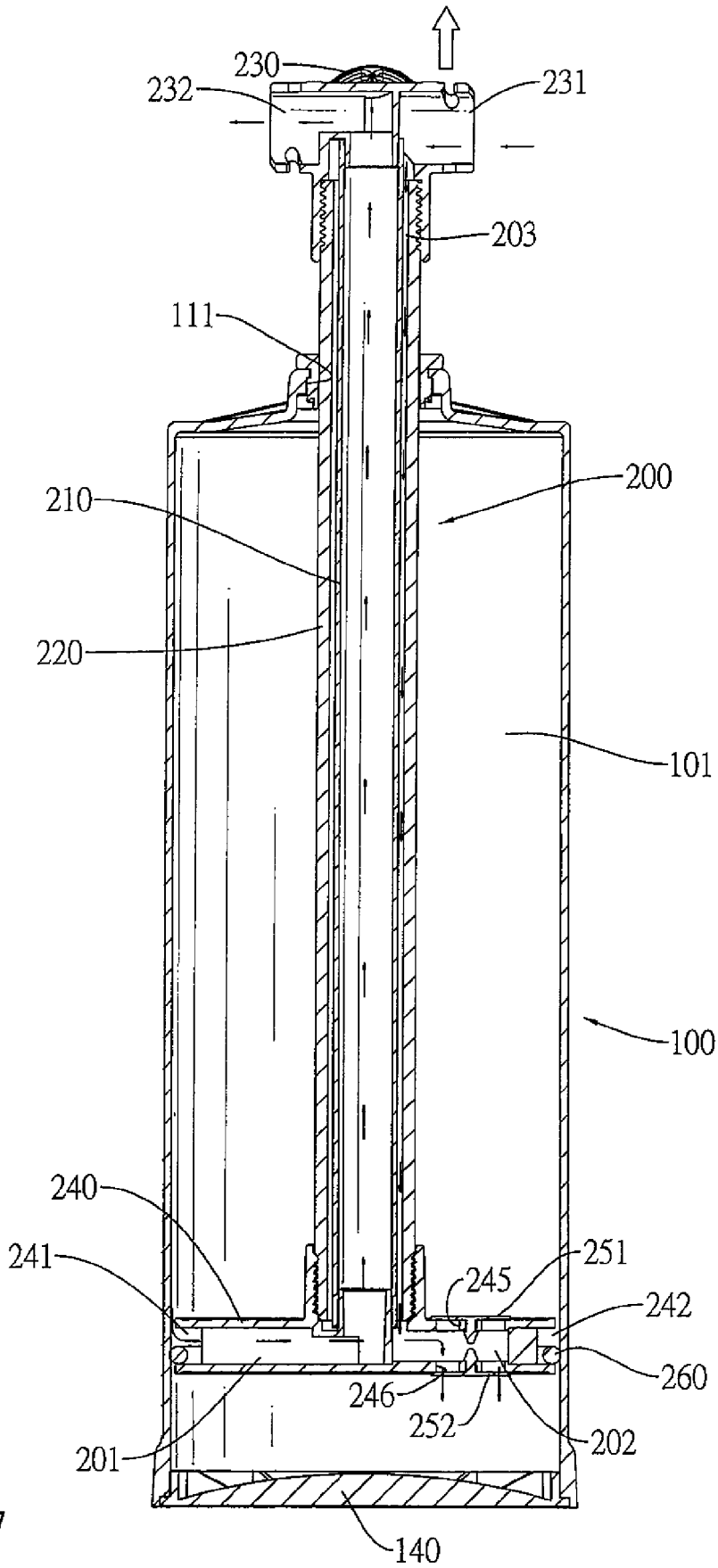
FIG. 7 is an operational cross sectional side view of the air pump in FIG. 2 with the piston assembly in an upstroke.

With reference to FIG. 7, in the upstroke, moving the piston assembly (200) upwards draws ambient air to flow into the inlet hose (231) of the handle (230), pass through the central hole (203), the inlet cavity (202), the upstroke holes (246) and then open the upstroke valve (252) to enter the lower sub chamber. The O-ring (260) abuts the bottom of the piston (240) and the air in the upper sub chamber flows through the radial passage (241), the outlet cavity (201), the outlet channel (211) and the outlet hose (232) and than enters the inflatable product.

Because the body (120), cap (110) and pedal (130) are formed by injection molding and the base (140) is welded to form the one-piece cylinder (100), the one-piece cylinder (100) is structurally firm and has excellent hermetic characteristics preventing leakage and disassembly under high pressure. Furthermore, the separate components of the air pump are few to facilitate storage management thereof.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An air pump, comprising:

a one-piece cylinder having a body having a top end, an open bottom end and a chamber defined in the body and having an inner sidewall;

a cap formed on the top end and having a through hole defined through the cap;

a pedal formed on the bottom end; and a base formed on and closing the open bottom end; and a piston assembly mounted slidably in the chamber and having a rod extending through the through hole in the chamber;

a handle mounted on the rod out of the cylinder; and a piston mounted on the rod and hermetically contacting the inner sidewall of the chamber; wherein:

the rod has an outer tube mounted through the through hole of the cap, extending slidably in the chamber of the cylinder and having a top end, a bottom end and a central hole defined through the outer tube and having a diameter; and an inner tube mounted in the central hole of the outer tube, having a top end and a bottom end and further having an outer diameter being smaller than the diameter of the central hole; and an outlet channel defined through the inner tube;

the handle has an inlet hose defined on the handle and communicating with the central hole of the outer tube; and an outlet hose defined on the handle and communicating with the outlet channel of the inner tube; and the piston divides the chamber into an upper sub chamber and a lower sub chamber, has a top, a bottom and an outer edge and further has an annular groove defined in the outer edge;

a radial passage defined radially in the outer edge and selectively communicating with the upper or lower sub chamber;

an outlet cavity defined in the piston and communicating with the radial passage and the outlet channel of the inner tube;

an inlet cavity defined in the piston and communicating with the central hole of the outer tube;

multiple downstroke holes defined through the bottom of the piston and communicating with the inlet cavity and the upper sub chamber;

multiple upstroke holes defined through the bottom of the piston and communicating with the inlet cavity and the lower sub chamber;

an O-ring mounted in the annular groove, hermetically contacting the inner sidewall of the chamber and selectively abutting the top or bottom of the piston;

a downstroke valve resiliently mounted on the top of the piston and selectively opening the downstroke holes; and an upstroke valve resiliently mounted on the bottom of the piston and selectively opening the upstroke holes.

2. The air pump as claimed in claim 1, wherein the body, cap, pedal and base are plastic.

3. The air pump as claimed in claim 1, wherein the downstroke and upstroke valves are rubber.

* * * * *